United States Patent [19]

Baril et al.

[11] 4,146,896

[45] Mar. 27, 1979

[54] 180° PHASE SHIFTER FOR MICROWAVES SUPPLIED TO A LOAD SUCH AS A RADIATING ELEMENT

[75] Inventors: Michel Baril; Jacques Legendre, both of Paris, France

[73] Assignee: Thomson-CSF, Paris, France

[21] Appl. No.: 799,764

[22] Filed: May 23, 1977

[51] Int. Cl.[2] ..... H01P 1/18; H01Q 3/26

[52] U.S. Cl. ..... 343/854; 333/204

[58] Field of Search ..... 333/73 S, 84 R, 84 M, 333/31 R; 343/768

[56] References Cited

U.S. PATENT DOCUMENTS

| | | | |
|---|---|---|---|
| 3,678,395 | 7/1972 | Hunton et al. | 333/84 M |
| 3,715,692 | 2/1973 | Reuss | 333/31 R |
| 4,070,639 | 1/1978 | Nemit | 333/84 M |

*Primary Examiner*—Eli Lieberman
*Attorney, Agent, or Firm*—Karl F. Ross

[57] ABSTRACT

A microstrip line, formed on a dielectric substrate by a conductor strip and a ground-plane layer or a pair of flanking coplanar layers, is electrically coupled to a slot line on that substrate with the aid of supplemental conductors establishing alternate microwave transmission paths between a terminal portion of the strip and respective slot edges. The supplemental conductors include a pair of diodes which are rendered selectively conductive to unblock one or the other transmission path, thereby enabling a 180° shifting of the phase of oscillations transmitted by the slot line to a load upon energization of the microstrip line by a source of microwaves. The load may be a radiating element of an electronically scanning antenna.

11 Claims, 4 Drawing Figures

180° PHASE SHIFTER FOR MICROWAVES SUPPLIED TO A LOAD SUCH AS A RADIATING ELEMENT

CROSS-REFERENCE TO RELATED APPLICATION

This application contains subject matter disclosed in our copending application Ser. No. 792,042 filed Apr. 28, 1977.

FIELD AND BACKGROUND OF THE INVENTION

The present invention relates to a diode-equipped microwave phase shifter capable of producing a 180° phase difference and adapted to be formed as a planar structure on a ceramic substrate of high dielectric constant, more specifically to a device facilitating phase reversal by a field inversion at a junction between a slot line and a line of different field structure such as a microstrip line of the single-ground-plane or the coplanar type as disclosed in our copending application.

There are various kinds of phase shifters equipped with PIN diodes and realizable as planar structures, such as 3dB-coupler phase shifters, switching phase shifters which employ the properties of shunt T's, and interference phase shifters which employ two diodes connected in parallel to a transmission line. The number of diodes, the phase shift, the standing-wave ratio (SWR), the insertion losses and the power-carrying capacity are criteria which influence the choice of one or other of these phase shifters.

However, these prior-art phase shifters involve lengths of transmission line liable to introduce phase shifts, losses and SWR characteristics which vary with frequency.

Another conventional phase shifter known from IEEE Transactions on microwave theory and techniques, April 1976, pages 231 ff, comprises a microstrip-to-microslot transition but does not provide for a phase changeover at the junction between the two lines.

OBJECTS OF THE INVENTION

The general object of our present invention is to provide a 180° phase shifter for oscillations in the microwave range which allows the utilization of different types of transmission lines at a source and at a load.

A more particular object of our invention is to provide a phase shifter of this description usable for the control of a radiating element of an electronically scanning antenna.

SUMMARY OF THE INVENTION

In accordance with our present invention, a junction of the type described in our above-identified copending application is formed between a first transmission line of symmetrical field structure and a second transmission line of asymmetrical field structure on a common dielectric substrate. First and second conductor means on the substrate respectively form a strip and a slot which codirectionally extend toward each other (e.g. from opposite ends of the substrate) and have closely juxtaposed terminal portions. The transmission of microwaves between these terminal portions is facilitated by supplemental conductor means including a pair of diodes inserted between the strip and respective lateral slot edges. We further provide biasing means for selectively blocking either one of these diodes while rendering the other diode conductive to establish a high-impedance path from the strip to one slot edge and a low-impedance path from the strip to the other slot edge.

The symmetrical field structure is a characteristic of a microstrip line (as more fully explained in our copending application) which could be either of the single-ground-plane type or of the coplanar type. In a coplanar line the strip is flanked by extensions of the slot-forming second conductor means, all the line conductors then lying on the same surface of the substrate. In the case of a single ground-plane layer, the slot is formed in that layer and lies on a substrate surface opposite the one carrying the strip. The supplemental conductor means may then include leads traversing the substrate or a pair of ancillary conductors extending laterally from the vicinity of the strip for a quarter-wavelength at the operating frequency to define with the ground-plane layer two open-circuited transmission lines with resulting establishment of a virtual short-circuit between that layer and each diode.

Pursuant to a more particular feature of our invention, the microstrip line has input connections to a source of microwaves while the slot line has output connections to a load such as a radiating element of an electronically scanning antenna.

BRIEF DESCRIPTION OF THE DRAWING

The above and other features of our invention will now be described in detail with reference to the accompanying drawing in which.

DETAILED DESCRIPTION

As indicated above, our invention aims at producing a 0–$\pi$ phase shifter equipped with PIN diodes which are positioned at a junction between two lines having differing electric field structures, disposed as planar structures on a ceramic substrate with codirectional, i.e. parallel or coincident, axes of propagation, namely a slot line of asymmetrical field structure and a microstrip line of symmetrical field structure.

A slot line is a transmission line formed by an incision or gap made in a ground plane applied to a dielectric substrate. The dielectric substrate provides the mechanical support for the metal conductors which are generally applied by known production techniques of photoetching or photolithography.

In such a slot line, virtually the entire energy propagates in the dielectric and is concentrated between the edges of the slot. The thickness of the dielectric material depends on its nature and the width of the slot line then determines the characteristic impedance of the line. The dielectric material may be polytetrafluorethylene, a beryllium oxide, an alumina ceramic, quartz, or a ferrite.

A microstrip line of the single-ground-plane type consists of a dielectric plate which carries a conductor strip on one major surface and a metallic layer termed the ground plane on its opposite surface. As in the case of the slot line, virtually the entire energy is concentrated in the dielectric.

A coplanar line differs from the aforedescribed microstrip line by having a metal strip of small thickness applied to one surface of a dielectric body between two ground electrodes paralleling the strip. When the dielectric constant is high, the major proportion of the energy is contained in the dielectric.

In a first approximation the diodes used, which are generally of the PIN type, behave either as an open circuit or as a short-circuit, depending on the polarity of an applied biasing voltage. Pursuant to our invention, at least two such diodes are disposed at the junction of a slot line and a microstrip line of either the single-ground-plane or the coplanar kind, i.e. in the area of transition between their different electric field structures. When one of the diodes conducts, the other being in a blocked state as a result of a reverse-biasing voltage applied to its terminals, the electric field at a particular point of the slot line is oriented in a certain direction at any given instant. When the polarity of the diodes is reversed, the diode which was conducting becomes blocked and the previously blocked diode becomes conducting. The result is that the electric field induced in the slot line changes its direction. Thus, there occurs in the transition zone of the two lines a phase shift equal to $\pi$. This is true over a relatively wide frequency band.

Figure 1:
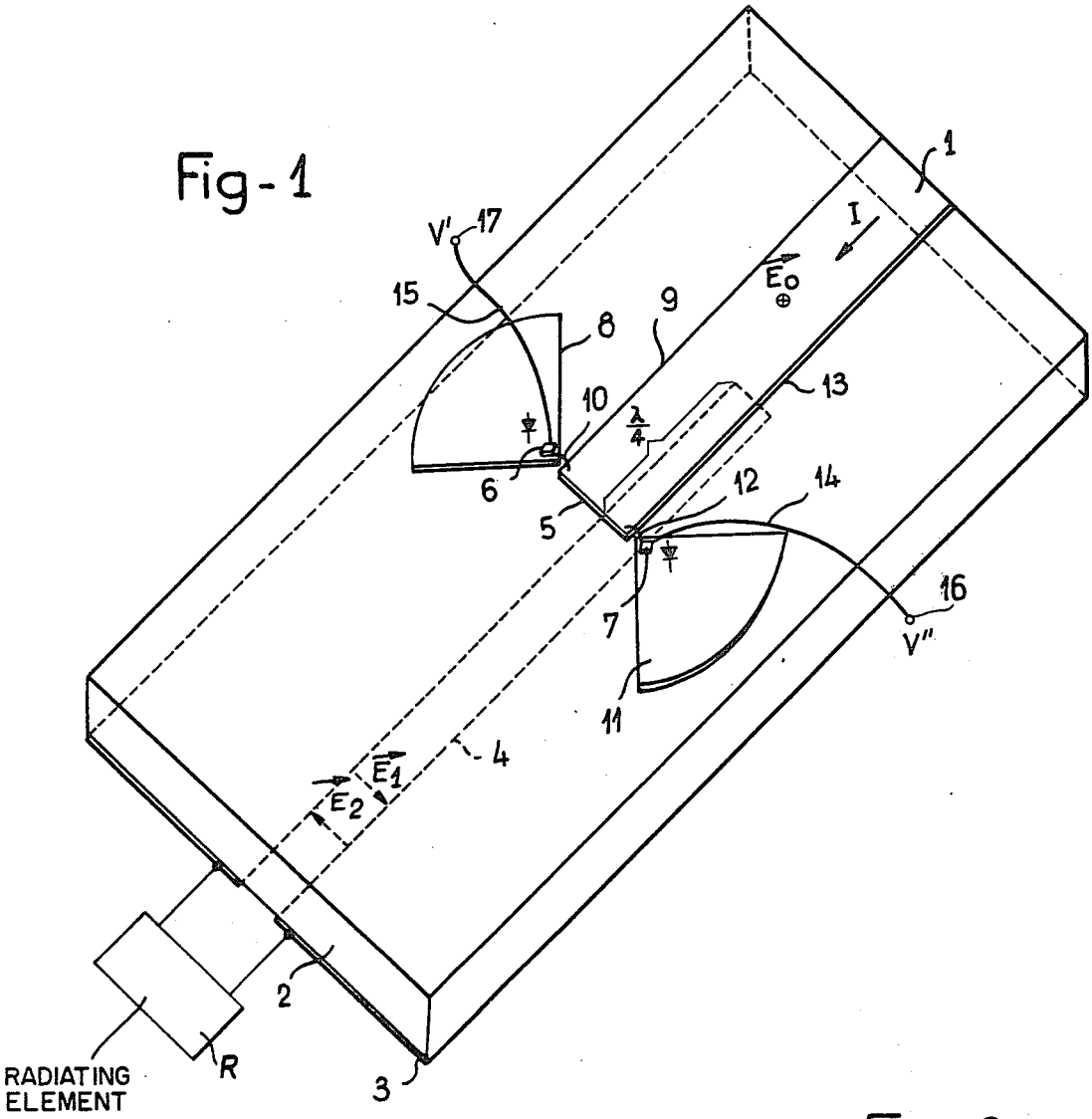
FIG. 1 is a perspective top view of a phase shifter according to our invention formed between a microstrip line and a slot line.
Figure 2:
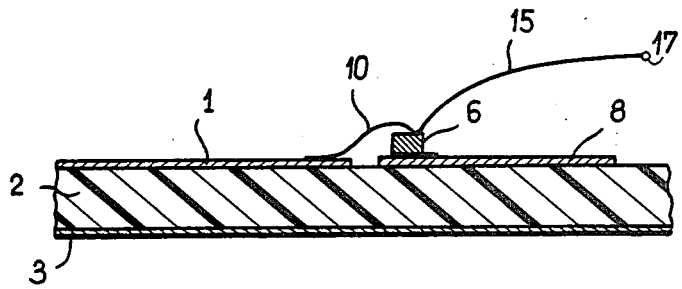
FIG. 2 is a fragmentary cross-sectional view of the phase shifter shown in FIG. 1.

As shown in FIG. 1, a microstrip line is obtained by depositing a conductive strip 1 of a certain length on a ceramic substrate 2 which is situated above a ground-plane layer 3. A slot 4 is cut in this ground-plane layer 3 to form another transmission line whose axis of propagation is parallel to the longitudinal axis of the strip 1. The two lines 1, 3 and 3, 4 extend from opposite edges of substrate 2 and overlap for a distance of the order of $\lambda/4$ so as to provide a satisfactory match. The free end of strip 1 is flanked by two diodes 6 and 7, generally of the PIN type. One of the terminals of diode 6 is attached, e.g. by soldering as seen in FIG. 2, to the vertex of a laterally extending sector-shaped conductor 8, formed on the upper surface of the substrate 2 carrying the strip 1, which defines with the bottom layer 3 an open-circuited ancillary transmission line measuring a quarter wavelength at an operating frequency. The other terminal of the diode 6 is connected to an edge 9 of the strip 1 by a lead 10. Diode 7 analogously has one of its terminals connected to a sector-shaped conductor 11 which is formed on the same substrate surface as ancillary conductor 8 and defines with layer 3 an identical open-circuited quarter-wavelength line. The other terminals of the diode 7 is connected by a lead 12 to the edge 13 of the strip 1. At that operating frequency, therefore, ancillary transmission lines 3, 8 and 3, 11 form virtual short-circuits between layer 3 and diodes 6, 7. These diodes could be attached directly by soldering to the strip 1 and to the quarter-wavelength lines by respective leads.

As disclosed in our copending application identified above, an electric field perpendicular to the microstrip line 1, 3 induces an electric field in the slot line 3, 4 if an off-axial connection is formed between one of the edges of the strip 1 and an underlying edge of the slot 4 via the corresponding quarter-wavelength line establishing a virtual short-circuit therebetween. Thus, with diode 6 biased into its conductive state and diode 7 blocked, the strip edge 9 is effectively connected to the upper edge of slot 4 (as viewed in FIG. 1) whereby an electrical field $\vec{E}_o$ applied to line 1, 3, giving rise to a current I, induces in line 4, 3 an electric field $\vec{E}_1$ oriented in a predetermined direction, this field being maximized by the fact that the short-circuited end of the slot line is separated by a distance of $\lambda/4$ from the point of its connection to the strip line. When the states of the diodes are reversed, diode 7 becoming conductive and diode 6 being blocked, the electric field $\vec{E}_2$ induced by the applied field $\vec{E}_o$ is of the same magnitude as the field $\vec{E}_1$ but oriented in the opposite direction. There is thus generated a phase difference of $\pi$ between these two states.

Wires 14 and 15 respectively connect the diodes 7 and 6 to schematically indicated sources 16 and 17 of suitable biasing voltages V″ and B′.

Figure 3:
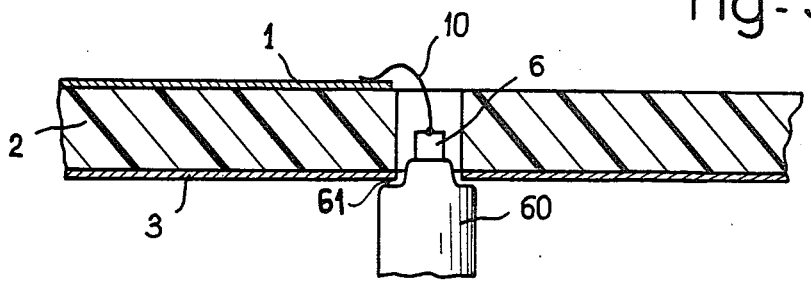
FIG. 3 is a cross-sectional view similar to FIG. 2, showing a modification of the phase shifter of FIG. 1.

In a modification, as shown in FIG. 3, the quarter-wavelength line is dispensed with and the strip 1 is directly joined to the slot line by a conductive connection passing through the substrate 2. In this instance the substrate has an aperture, perpendicular to the strip 1, in which the diode 6 is mounted on a support 60 at the level of layer 3. The lead 10 connects one electrode of the diode directly to an edge of the strip 1 and also acts as a biasing conductor upon being extended to a suitable voltage source. The connection is completed at 61 by contact between the support 60 and the ground-plane layer. A similar arrangement for diode 7 has not been illustrated.

Figure 4:
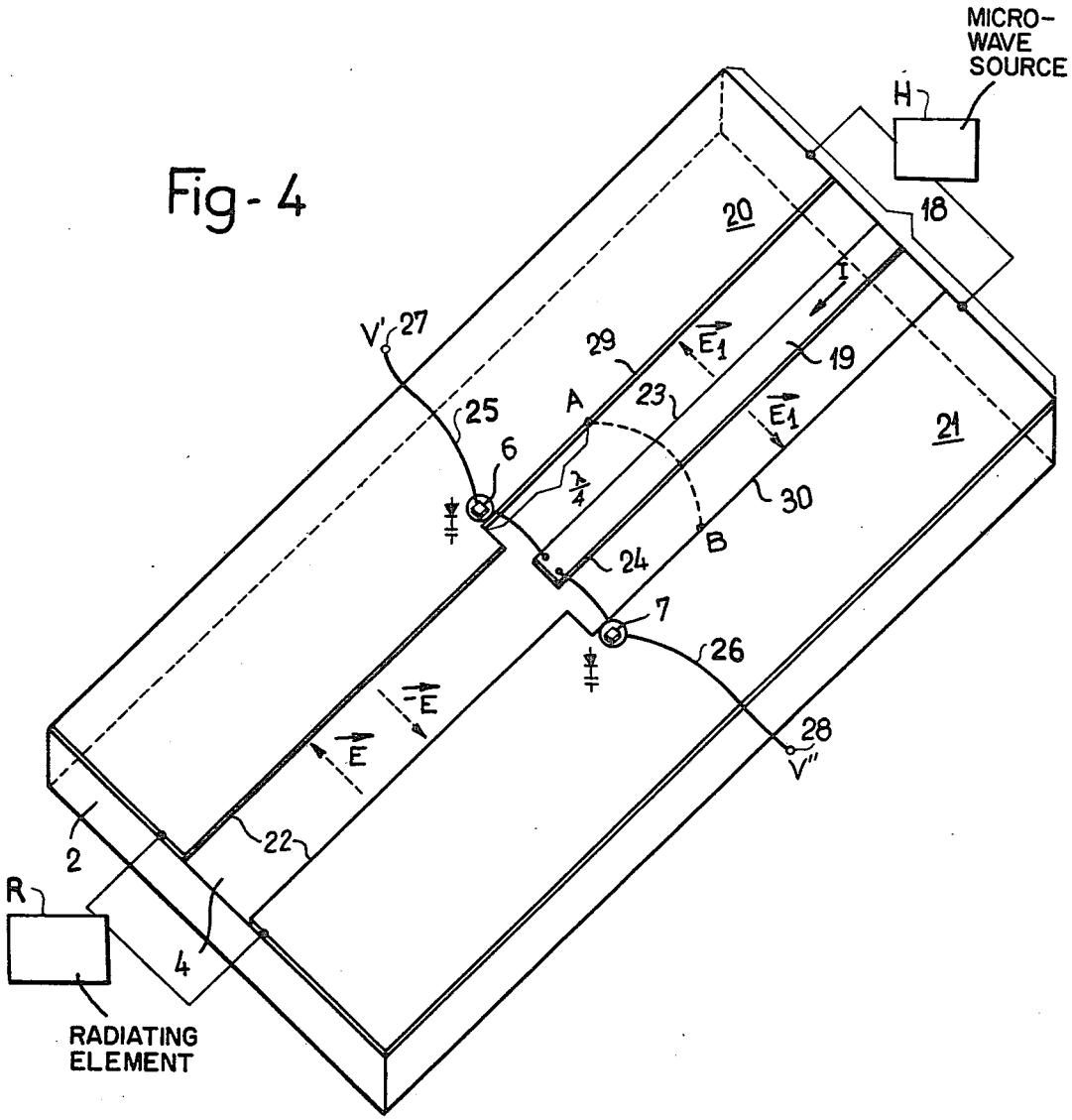
FIG. 4 is a perspective top view of a phase shifter according to our invention formed between a slot line and a coplanar line.

FIG. 4 shows another embodiment of a phase shifter according to the invention which is formed in a transition zone between a slot line and a coplanar line.

The slot 4 is here cut out in a metal layer 22 with extensions forming two electrodes 20 and 21 which bracket a conductive strip 19 lying on the same surface of substrate 2 and defining with these electrodes a coplanar line 18; strip 19 is aligned with slot 4. At the junction of slot line 22, 4 with coplanar line 18 we again provide two PIN diodes 6 and 7. One terminal of each diode 6 and 7 is connected to an edge 23 or 24 of strip 19 while the other terminal is connected, by a respective wire 25 or 26, to a source 27 or 28 of biasing voltage V′ or V″. A capacitor positioned under each diode completes a transmission path for microwaves between strip 19 and a respective slot edge. When diode 6, for example, is conductive, the other diode 7 being blocked, the electric field $\vec{E}_1$ applied to the coplanar line 18 is unsymmetrically transmitted to the slot line 4, 22 where it sets up the field $\vec{E}$. When the polarities of the diodes are changed, that is to say when the diode 6 is blocked and the diode 7 conducts, the electric field propagated in the slot line 4 becomes $-\vec{E}$. These fields $\vec{E}$ and $-\vec{E}$, which are of equal absolute magnitudes, reach a maximum if a short-circuiting connection A-B between the edges 29 and 30 of the coplanar line 18 is formed at a distance of $\lambda/4$ from the line junction provided with the diodes 6, 7.

It will be noted that there occurs a phase shift of $\pi$ between the two states described.

In the embodiments described, the width of the strip, the width of the slot and the thickness of the substrate are determined by the value of the characteristic impedance of the transmission line upstream and downstream of the plane of the diodes. Proper matching of this characteristic impedance enables maximum transmitted power to be achieved with a low SWR which may be close to 1.

The phase shifters according to our invention are particularly stable and show little variation in phase shift, attenuation and standing-wave ratio over a wide frequency band. They may advantageously be used in electronically scanning antennas, being connected directly to a radiating element especially if the latter is a slot on a substrate. In this case, as schematically indicated in FIG. 4, a radiating element R can be connected to the slot line 4, 22 and a source of energy H can be connected to the coplanar line 18. Such a radiating element R has also been shown connected to the line of asymmetrical field structure in FIG. 1, i.e. to the slot line 3, 4.

An article in IEEE Transaction in microwave theory and techniques, vol. MTT 23, No. 3, pages 275–281, entitled "an integrated circuit balanced mixer, image and sum enhanced", may be referred to as pertinent art.

We claim:

1. In an assembly for the propagation of microwaves, in combination:

a dielectric substrate;

a first transmission line of symmetrical field structure comprising first conductor means forming a strip on said substrate, said first transmission line having input connections to a source of microwaves;

a second transmission line of asymmetrical field structure comprising second conductor means on said substrate forming a slot codirectional with said strip, said slot and said strip having closely juxtaposed terminal portions, said second transmission line having output connections to a load;

supplemental conductor means on said substrate for facilitating the transmission of microwaves between said terminal portions, said supplemental conductor means including a pair of diodes inserted between said strip and respective lateral edges of said slot; and biasing means separate from said input and output connections for selectively blocking either one of said diodes while rendering the other diode conductive to establish a high-impedance path from said strip to one of said lateral edges and a low-impedance path from said strip to the other of said lateral edges, said biasing means being reversible to shift the phase of a load current by 180°.

2. The combination defined in claim 1 wherein said first and second conductor means are disposed on a common substrate surface, said first conductor means further including extensions of said second conductor means flanking said strip.

3. The combination defined in claim 2 wherein each of said diodes is in series with a respective capacitor.

4. The combination defined in claim 2 wherein said extensions are bridged by a short-circuiting connection at a location spaced from the region of said diodes by a quarter-wavelength at the frequency of said microwaves.

5. The combination defined in claim 1 wherein said substrate is a flat plate with a pair of major surfaces, said strip lying on one of said major surfaces, said second conductor means being a ground-plane layer common to both said transmission lines disposed on the other of said major surfaces.

6. The combination defined in claim 5 wherein said supplemental conductor means comprises a lead in series with each diode traversing said substrate.

7. The combination defined in claim 5 wherein said supplemental conductor means comprises a pair of ancillary conductors extending laterally on said one of said major surfaces from the vicinity of said strip, each of said ancillary conductors forming with said ground-plane layer an open-circuited ancillary line of a quarter-wavelength at the frequency of said microwaves.

8. The combination defined in claim 7 wherein said ancillary conductors are sector-shaped layers each having a vertex adjacent said strip.

9. The combination defined in claim 8 wherein each of said diodes is inserted between said strip and the vertex of the respective sector-shaped layer.

10. The combination defined in claim 5 wherein said terminal portions overlap for a quarter-wavelength at the frequency of said microwaves.

11. The combination defined in claim 1 wherein said load is a radiating element of an electronically scanning antenna.

* * * * *